US005806973A

United States Patent [19]

Porter

[11] Patent Number: 5,806,973

[45] Date of Patent: Sep. 15, 1998

[54] LAMP WITH ILLUMINATED BODY

[75] Inventor: David H. Porter, Chagrin Falls, Ohio

[73] Assignee: The L.D. Kichler Co., Cleveland, Ohio

[21] Appl. No.: 671,910

[22] Filed: Jun. 28, 1996

[51] Int. Cl.[6] ..... F21S 1/12

[52] U.S. Cl. ..... 362/412; 362/236; 362/246; 362/249

[58] Field of Search ..... 362/227, 234–236, 362/244, 246, 248, 249, 410, 412, 417, 184, 250, 285, 413; 40/554, 558

[56] References Cited

U.S. PATENT DOCUMENTS

| | | | |
|---|---|---|---|
| 1,863,607 | 6/1932 | Sabath | 362/412 |
| 1,966,485 | 7/1934 | Chanock | 362/247 |
| 2,244,298 | 6/1941 | Icove et al. | 362/246 |
| 2,945,948 | 7/1960 | Maffei | 362/412 |
| 5,473,525 | 12/1995 | Stout | 362/412 |
| 5,530,633 | 6/1996 | Yuen | 362/184 |
| 5,620,247 | 4/1997 | Swanson | 362/250 |
| 5,632,553 | 5/1997 | Huang | 362/250 |

FOREIGN PATENT DOCUMENTS

| | | | |
|---|---|---|---|
| 440760 | 5/1912 | France | 362/412 |

*Primary Examiner*—Alan Cariaso
*Attorney, Agent, or Firm*—Watts, Hoffmann, Fisher & Heinke, Co., L.P.A.

[57] ABSTRACT

A lamp assembly includes a body, support structure adjacent the body, and a socket for carrying a bulb, the socket being connected to the support structure. An illumination light source is adapted to illuminate the body by directing light into the interior of the body. The body is comprised of a light transmissive material.

19 Claims, 2 Drawing Sheets

LAMP WITH ILLUMINATED BODY

FIELD OF THE INVENTION

The present invention is directed to a lamp and, in particular, to a lamp having an illuminated body.

BACKGROUND OF THE INVENTION

In a typical table lamp a body is mounted to a base of the lamp. A socket which is disposed above the body is connected to support structure mounted to the body. The lamp includes a typical harp for mounting a shade. Area lighting is provided by an incandescent light bulb carried by the socket. The lamp includes electrical wires that at one end lead to an external plug for insertion into an electrical outlet and at the other end lead to the socket.

A table lamp often includes a decorative body which, if it is hollow, is capped at its upper end. Light that radiates from the bulb is reflected downwardly by the shade, so that only a small amount of indirect light from the light bulb contacts the body.

SUMMARY OF THE INVENTION

In addition to the light provided by an ordinary incandescent light bulb, the lamp assembly of the present invention also radiates an illuminating light. The illuminating light is directed into the interior of a body comprised of light transmissive material, such as lead crystal or the like, to illuminate the body and create a beautiful display.

In general, the lamp assembly includes a body, support structure adjacent the body, and a socket for carrying a light bulb, the socket being connected to the support structure. The improvement comprises an illumination light source adapted to illuminate the body by directing light into its interior. The body is comprised of a light transmissive material.

In one aspect of the invention, the body has a hollow interior and an opening that communicates with its interior. The illumination light source is preferably positioned to direct light through the opening into the interior of the body. The body opening may be located in an upper portion of the body and the illumination light source may be suspended above the body opening. The body is preferably comprised of glass crystal. The illumination light source is preferably a halogen lamp.

In another aspect of the invention, the lamp assembly includes a housing in which the illumination light source is disposed. The housing is mounted to the support structure and is preferably spaced apart from the body. The socket is connected to the housing. The support structure may be hollow and adapted to receive electrical wire. The lamp assembly may also include a base on which the body is mounted, the support structure extending upwardly from the base.

In one preferred embodiment, the lamp includes an upstanding body made of light transmissive material. A tubular support extends from near the bottom of the body to a location above its upper end. A first light source mounting means is carried by the support for mounting a first light source in position to illuminate the body. A second light source mounting means is carried by the support for mounting a second light source in position to provide area illumination. Means for mounting a shade in conjunction with the second light source is provided. Electrical wiring extends within the support to the means for mounting the first and second light sources.

More specifically, the first light source mounting means is adapted to mount the first light source in position to shine down on the top of the body and is below the second light source mounting means. The body is hollow and has an open upper end.

In another preferred embodiment, the body has a hollow interior and an opening that communicates with its interior. The illumination light source is a halogen lamp that is connected to the support structure and positioned adjacent the body opening. The halogen lamp is adapted to illuminate the body by directing light through the body opening into its interior. The body opening is more preferably located in the upper portion of the body, the halogen lamp being suspended above the upper opening.

By being suspended above the upper opening in the body, the halogen lamp may easily direct light into the interior of the lamp to illuminate the body. The halogen lamp radiates light of a high intensity so that even materials through which little light can be transmitted are illuminated. Moreover, by being disposed in the housing spaced apart from the body, the halogen lamp does not heat the body excessively.

A method of operating the lamp assembly according to the invention to create a beautiful display includes the step of radiating the illuminating light from the illumination light source. The illuminating light is directed into the interior of the body, which is illuminated thereby. The illuminating light is preferably directed through the opening in the body into its interior. The illuminating halogen light is preferably radiated from a location above the body. Area lighting in the form of ordinary incandescent light may be radiated from the light bulb.

Other embodiments of the invention are contemplated to provide particular features and structural variants of the basic elements. The specific embodiments referred to as well as possible variations and the various features and advantages of the invention will become better understood from the detailed description that follows, together in connection with the accompanying drawings.

DETAILED DESCRIPTION OF PREFERRED EMBODIMENTS

Figure 1:
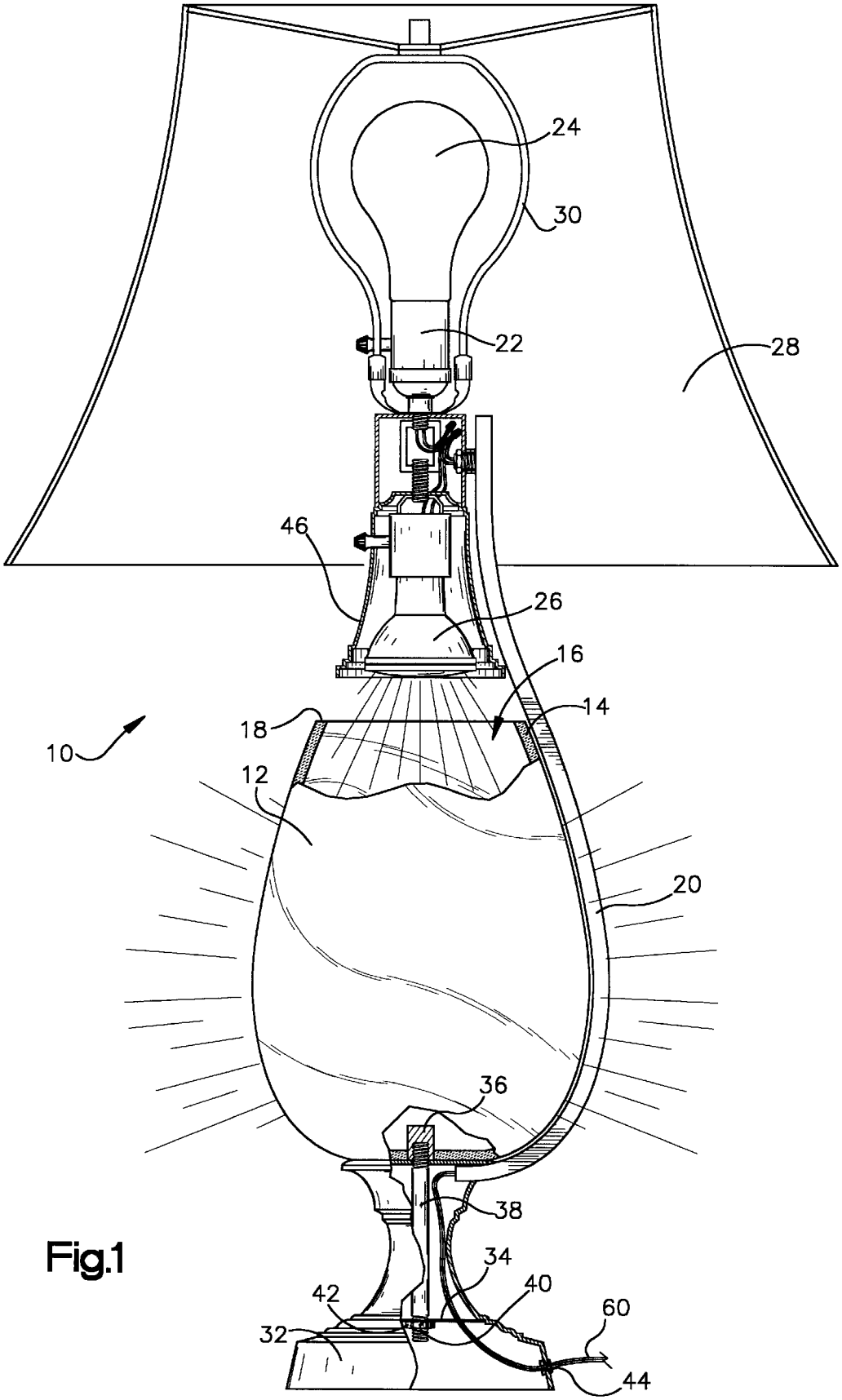
FIG. 1 is a partial cross-sectional view of a lamp assembly constructed in accordance with the present invention.

Turning to the drawings, FIG. 1 shows a lamp assembly generally at 10, which is constructed according to the present invention. The lamp assembly 10 includes a body 12 which preferably includes a wall 14 that forms a hollow interior 16. An upper opening 18 of the body communicates with its interior 16. A support arm 20 is disposed adjacent the body 12. A socket 22 is supported by the support arm 20 and carries an ordinary incandescent light bulb 24 in a well known manner. An illumination lamp 26 is supported by the arm 20 and disposed adjacent the upper opening 18 of the body 12. The illumination lamp 26 is referred to herein as a first light source and the socket 22 and the bulb 24 are referred to herein as a second light source.

Although the illustrated lamp assembly 10 is a table lamp, it will be appreciated by those skilled in the art that the present invention may apply to other types of lamps as well, including upright lamps. The lamp assembly 10 includes a typical shade 28 and a harp 30 for mounting the shade. The bulb 24 provides light that illuminates the area surrounding the lamp assembly as is well known.

The lamp assembly 10 preferably includes a base 32 upon which the body 12 is mounted. Although the body 12 is preferably hollow, a solid body may be used depending upon factors including the intensity of the illumination lamp 26 and the light transmissibility of the body. The arm 20 preferably extends from near the bottom of the body 12. The lamp assembly 10 could be constructed without the base 32, in which case the arm 20 would be disposed adjacent or connected to the body 12.

The base 32 is preferably hollow and has a support plate 34 in its interior. The body 12 includes an interior threaded member 36 at its lower portion. A rod 38 connects the body 12 to the base 32. Exterior threads on the upper end portion of the rod 38 are threaded to the interior threads of the threaded member 36, while exterior threads on the lower end portion of the rod 38 are threaded to an interior threaded opening 40 in the base support plate 34. The rod 38 is secured to the support plate 34 such as by a nut 42. An insert 44 having a central opening is disposed in an opening in the base 32.

The support arm 20 is preferably a hollow tube and at its lower end is preferably soldered to the base 32. Any number of arms 20 may be used. The upper end of the arm 20 preferably extends to a location above the body 12.

Figure 2:
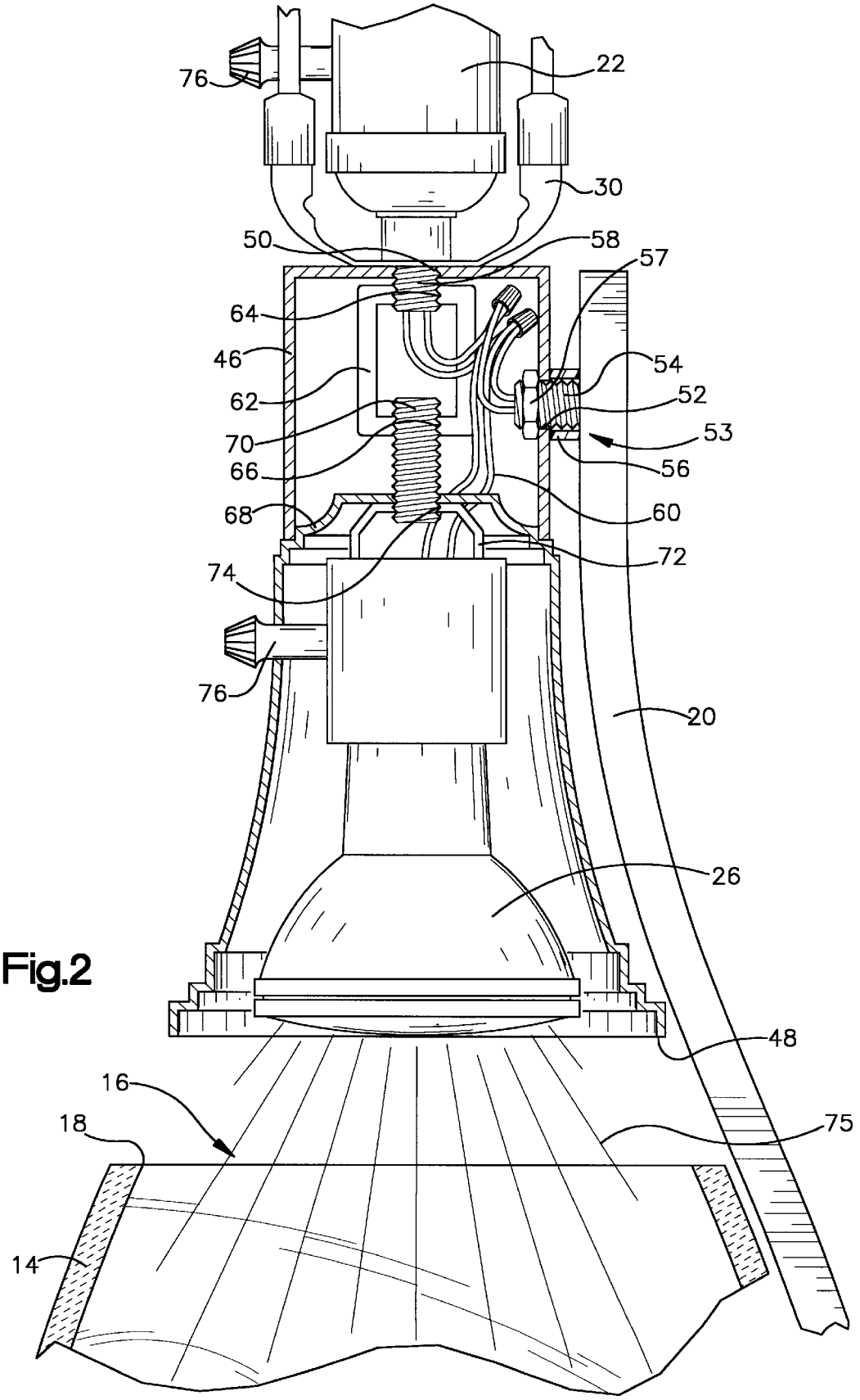
FIG. 2 is an enlarged cross-sectional view showing portions of the lamp assembly of FIG. 1.

As shown in FIG. 2, the lamp assembly 10 may include a housing 46 that has an opening 48 at its lower portion and threaded openings 50, 52 in its upper and side portions, respectively. Housing mounting fasteners 53, which include a threaded member 54, a spacer 56 and a nut 57, are used to mount the housing 46 to the arm 20. The threaded member 54 is hollow and extends laterally from the top of the arm 20 into the threaded opening 52 in the side of the housing. The spacer 56 is interposed between the housing 46 and the arm 20. The nut 57 is threaded onto one end of the threaded member 54 to secure the housing 46 to the arm 20. A threaded socket rod 58 extends from the socket 22 through the upper opening 50 of the housing. The illumination lamp 26 is preferably disposed within the housing 46.

Electrical wires 60 terminate at one end in a plug (not shown) and extend through the opening in the insert 44 into the base 32. The insert 44 secures the wires 60 to the base 32. The wires 60 extend through the base 32 to the arm 20. The wires 60 extend upwardly through the hollow interior of the arm 20, through the hollow threaded member 54 and into the housing 46. The wires 60 extend into the socket rod 58 and also extend to the illumination lamp 26. The wires 60 are electrically coupled to the socket 22 and to the illumination lamp 26 in a manner that will be apparent to those skilled in the art in view of this disclosure. Since the electrical wires 60 do not extend into the body 12, the wires are completely hidden from view even when a clear glass body 12 is used.

A nut member 62 having two opposing threaded holes 64, 66 is disposed in the interior of the housing 46. The harp 30 has an opening in its lower portion that receives the threaded socket rod 58. The nut member 62 is threaded to the threaded socket rod 58 into abutment with an inner surface of the housing 46. This fastens the socket 22 and the harp 30 to the top of the housing 46. Second mounting means for mounting the socket 22 and the bulb 24 to the arm 20 includes the socket rod 58, a fastener such as the nut member 62 for mounting the socket to the housing 46, and the housing mounting fasteners 53.

The housing 46 includes a support plate 68 in its interior. A rod 70 having exterior threads is disposed in the interior of the housing 46. The illumination lamp 26 includes a support 72 at its upper end having a threaded opening 74. The lamp support 72 is threaded to the lower end portion of the threaded rod 70 into abutment with a lower surface of the housing support plate 60, which mounts the illumination lamp 26 in the interior of the housing 46.

A first light source mounting means for mounting the illumination lamp 26 to the arm 20 includes the housing support plate 68, the lamp support 72, the threaded rod 70, a fastener such as the nut member 62, and the housing mounting fasteners 53. Although the particular fasteners described herein with respect to the first and second light source mounting means are preferred, it will be appreciated by those skilled in the art that other fasteners may be employed in the present invention to mount the first and second light sources to the arm 20.

The body 12 may be formed of any material through which light can be transmitted. The body 12 is preferably comprised of a decorative material such as glass crystal, lead crystal being most preferable. The socket 22 is formed of metal. The housing 46, the arm 20 and the base 32 may be formed of any materials and are preferably formed of metals, more preferably, brass with a gold plate or polished finish.

The illumination lamp 26 is used in addition to the light bulb 24. The illumination lamp 26 is any lamp that can emit illuminating light 75 of a suitably high intensity into the interior of the body 12 to illuminate the body 12. To this end, the lamp 26 is preferably a halogen lamp. A 50 Watt halogen lamp is suitable for use in the present invention. A halogen lamp is preferable in the present invention because it produces light having a high intensity. The halogen lamp 26 even illuminates bodies formed from material through which little light can pass.

Since the halogen lamp 26 is preferably disposed in the housing 46 spaced apart from the body 12, it illuminates the body 12 without heating it excessively. When the high intensity light is radiated from the halogen lamp 26, the body is illuminated even though the illuminating light 75 traverses the space between the housing 46 and the body 12.

More than one first and second light source mounting means and first and second light sources may be used. Also, as will be appreciated by those skilled in the art, the body opening 18, the housing 46 and the halogen lamp 26 may be oriented differently. For example, the housing 46 may contact the body 12 or the halogen lamp 26 may be positioned within the interior of the body 12. If it is desired to position the halogen lamp 26 in the body 12, a smaller halogen lamp, a body having a larger interior or comprised of a heat resistant material, or a device that reduces heating of the body, may be employed.

The halogen lamp 26 and the socket 22 each includes a typical on-off switch 76. The halogen lamp 26 may be constructed to emit one or more colors of light into the body 12. Similarly, the body 12 may comprise colored material or a material having the ability to illuminate the body 12 in one or more colors.

In the operation of the lamp assembly as a display, the body 12 is illuminated by radiating the illuminating halogen light 75 from the halogen lamp 26 at a location above the body 12. The illuminating light 75 passes through the lower housing opening 48, through the body opening 18 and into the interior 16 of the body 12. Since the body 12 is comprised of light transmissive material, the illuminating light 75 illuminates the body upon entering its interior. Thus, the lamp assembly is operated as a beautiful display in addition to radiating ordinary light from the bulb 24.

Although the invention has been described in its preferred form with a certain degree of particularity, it will be understood that the present disclosure of the preferred embodiments has been made only by way of example and that various changes may be resorted to without departing from the true spirit and scope of the invention as hereafter claimed.

What is claimed is:

1. In a lamp assembly including a body, support structure adjacent said body, and a socket for carrying a light bulb, the socket being connected to said support structure, the improvement comprising an illumination light source that illuminates said body by directing light into an interior of said body, said body being comprised of light transmissive material and having an opening located at an upper portion thereof, wherein said illumination light source is connected to said support structure so as to be suspended above said body and below said socket in position to shine light down into the opening.

2. The improvement of claim 1 wherein said interior of said body is hollow and said opening communicates an area outside said body with said interior.

3. The improvement of claim 1 comprising a base on which said body is mounted.

4. The improvement of claim 3 wherein said support structure extends upwardly from said base.

5. The improvement of claim 1 wherein said body is comprised of glass crystal.

6. The improvement of claim 1 wherein said illumination light source is a halogen lamp.

7. The improvement of claim 6 wherein said body has a hollow interior which does not contain a lamp or a reflective surface other than an interior surface of said body.

8. The improvement of claim 1 comprising a housing in which said illumination light source is disposed, said housing being mounted to said support structure and spaced apart from said body.

9. The improvement of claim 8 wherein said socket is connected to said housing.

10. The improvement of claim 1 wherein said support structure is hollow, opaque and disposed outside said body and said lamp assembly comprises electrical wire that extends along substantially an entire length of said support structure.

11. In a lamp assembly including a base, a body mounted to said base, support structure adjacent said body, and a socket for carrying a light bulb, the socket being connected to said support structure, the improvement wherein said body is comprised of light transmissive material and has a hollow interior and an opening located at an upper portion thereof that communicates with said interior, and a halogen lamp is connected to said support structure so as to be suspended above the body opening and below said socket in position to direct light down through the body opening into said interior.

12. The improvement of claim 11 comprising a housing in which said halogen lamp is disposed, said housing being mounted to said support structure and spaced apart from said body.

13. The improvement of claim 11 wherein said body is comprised of glass crystal.

14. The improvement of claim 11 wherein said support structure is hollow, opaque and extends outside said body and said lamp assembly comprises electrical wire that extends along substantially an entire length of said support structure.

15. The improvement of claim 1 wherein said illumination light source comprises a halogen lamp and said body is comprised of a material having low light transmissibility.

16. A lamp comprising a) an upstanding body made of light transmissive material, b) a tubular support extending from near the bottom of said body to a location above its upper end, c) first light source mounting means carried by said support for mounting a first light source in position to illuminate said body, d) second light source mounting means carried by said support for mounting a second light source in position to provide area illumination, e) means for mounting a shade in conjunction with said second light source, and f) electrical wiring extending within said support to said means for mounting said first and second light sources, wherein said first light source mounting means is adapted to mount the first light source in position to shine light down on the top of said body and is below said second light source mounting means.

17. A lamp as claimed in claim 16 wherein said body is hollow and has an opening located at an upper portion thereof.

18. A method of operating a lamp assembly to create a display, comprising radiating illuminating light from an illumination light source of the lamp assembly suspended at a location above a body of the lamp assembly, the body being comprised of a light transmissive material, directing said illuminating light into an opening in an upper portion of said body which communicates an area outside of said body with an interior of said body, illuminating said body with said illuminating light, and radiating incandescent light from a light bulb of the lamp assembly located above said illumination light source.

19. The method of claim 18 comprising illuminating said body with halogen light as said illuminating light.

* * * * *